US009227211B2

(12) United States Patent
Sammons

(10) Patent No.: US 9,227,211 B2
(45) Date of Patent: Jan. 5, 2016

(54) SPRAY DISPENSER AND METHOD FOR USING

(71) Applicant: Elizabeth M Sammons, Rye, NY (US)

(72) Inventor: Elizabeth M Sammons, Rye, NY (US)

( * ) Notice: Subject to any disclaimer, the term of this patent is extended or adjusted under 35 U.S.C. 154(b) by 0 days.

(21) Appl. No.: 13/760,530

(22) Filed: Feb. 6, 2013

(65) Prior Publication Data

US 2014/0217125 A1 Aug. 7, 2014

(51) Int. Cl.

| | |
|---|---|
| ***B67D 7/58*** | (2010.01) |
| ***B05B 11/00*** | (2006.01) |
| ***B05B 15/00*** | (2006.01) |

(52) U.S. Cl.

CPC ..... *B05B 11/0037* (2013.01); *B05B 11/0059* (2013.01); *B05B 15/005* (2013.01)

(58) Field of Classification Search

CPC .. B05B 11/0059; B05B 15/005; B65D 83/32; B65D 1/04

USPC ..... 222/377, 454, 464.1–464.7, 211, 189.1, 222/382

See application file for complete search history.

(56) References Cited

U.S. PATENT DOCUMENTS

| | | | | |
|---|---|---|---|---|
| 727,660 | A | 5/1903 | Masterson | |
| 1,523,688 | A * | 1/1925 | Freeman | 222/377 |
| 3,178,081 | A * | 4/1965 | Adams | G01F 11/262 215/391 |
| 3,181,745 | A * | 5/1965 | Grobowski | 222/539 |
| 3,661,288 | A * | 5/1972 | Noll | 215/11.1 |
| 4,645,097 | A * | 2/1987 | Kaufman | 222/207 |
| 4,830,235 | A | 5/1989 | Miller | |
| 5,083,683 | A | 1/1992 | Knickerbocker | |
| 5,195,664 | A | 3/1993 | Rhea | |
| 5,279,450 | A | 1/1994 | Witt, Jr. | |
| 5,518,150 | A | 5/1996 | Witt, Jr. | |
| 5,638,994 | A | 6/1997 | Libit et al. | |
| 5,934,519 | A | 8/1999 | Kim et al. | |
| 5,979,715 | A | 11/1999 | Emrick | |
| 6,059,152 | A | 5/2000 | Mayfield | |
| 6,264,073 | B1 | 7/2001 | Good et al. | |
| 6,360,918 | B1 * | 3/2002 | Butler | 222/136 |
| 6,386,394 | B1 * | 5/2002 | Vollrath | G01F 11/266 222/207 |
| 6,394,319 | B1 | 5/2002 | Pucillo | |
| 6,833,072 | B1 | 12/2004 | Krestine et al. | |
| 6,871,760 | B1 | 3/2005 | Snider | |
| 7,048,156 | B2 * | 5/2006 | Weck | B05B 11/0037 222/377 |
| 7,055,722 | B2 | 6/2006 | Ouellette | |
| 7,118,012 | B2 * | 10/2006 | Butler | 222/129 |
| 8,789,728 | B2 * | 7/2014 | Huffman | B05B 11/0008 222/382 |
| 8,881,953 | B2 * | 11/2014 | Dennis | B05B 11/001 222/382 |
| 2004/0112922 | A1 * | 6/2004 | Ouellette | 222/382 |
| 2005/0087568 | A1 | 4/2005 | Silvaggio | |
| 2006/0237485 | A1 | 10/2006 | An | |
| 2007/0241139 | A1 | 10/2007 | Shade | |
| 2008/0023499 | A1 * | 1/2008 | Knight | 222/464.7 |

(Continued)

*Primary Examiner* — Paul R Durand
*Assistant Examiner* — Randall Gruby
(74) *Attorney, Agent, or Firm* — Ohlandt, Greeley, Ruggiero & Perle, L.L.P.

(57) ABSTRACT

A spray dispenser. The spray dispenser has a spray mechanism and a bottle. The spray mechanism includes a sprayer and a siphon tube. The siphon tube defines a proximal end and a distal end. The proximal end of the siphon tube is in fluid communication with the sprayer. The bottle defines an inverted catchment therein adjacent a wall of the bottle. The siphon tube defines a generally U-shaped portion therein proximal to the distal end of the siphon tube. The distal end of the siphon tube is positioned within the inverted catchment. There is also a spray product and a method for spraying a liquid formulation onto a surface.

6 Claims, 7 Drawing Sheets

(56) References Cited

U.S. PATENT DOCUMENTS

| | | | | |
|---|---|---|---|---|
| 2008/0169316 | A1 | 7/2008 | Ganiere | |
| 2008/0245824 | A1 | 10/2008 | Lyles | |
| 2009/0008414 | A1* | 1/2009 | Tingsley | 222/377 |
| 2009/0071983 | A1* | 3/2009 | Pritchard | 222/211 |
| 2009/0212077 | A1 | 8/2009 | Carden | |
| 2009/0230153 | A1* | 9/2009 | Knight | 222/383.1 |
| 2010/0270334 | A1 | 10/2010 | Gioia | |
| 2011/0101034 | A1 | 5/2011 | Baeten et al. | |
| 2012/0006855 | A1* | 1/2012 | Ehrmann | 222/377 |
| 2012/0018458 | A1 | 1/2012 | Chernik et al. | |
| 2012/0205402 | A1* | 8/2012 | Chapin | 222/321.5 |
| 2013/0206796 | A1* | 8/2013 | Hayakawa et al. | 222/464.7 |

* cited by examiner

SPRAY DISPENSER AND METHOD FOR USING

BACKGROUND OF THE DISCLOSURE

1. Field of the Disclosure

The disclosure relates to a spray dispenser. The disclosure further relates to a spray dispenser useful in spraying a liquid on a horizontal surface. The disclosure further relates to a method for spraying a liquid on a surface using the spray dispenser.

2. Description of the Related Art

Spray bottles are commonly used to spray liquid formulations onto surfaces for the purpose of cleaning, polishing, and the like. Spray bottles most commonly take the form of a trigger spray bottle employing a siphon tube to draw out and spray a liquid formulation. The siphon tube typically extends toward the bottom of the bottle.

A problem arises with trigger spray bottles when they are deployed horizontally to spray a liquid formulation on a horizontal surface, such as a floor, carpeting, kitchen counter, or table. In a conventional trigger spray bottle, the siphon tube is vertical. As the liquid formulation in the bottle diminishes in level with use, shifts of the formulation within the bottle may result in the siphon tube being exposed or unsubmerged, which would prevent the trigger sprayer bottle from functioning properly, i.e., from spraying the liquid formulation.

It would be desirable to have a spray dispenser that maintains spraying functionality when the dispenser is deployed horizontally and that would spray substantially all of the formulation from the bottle.

SUMMARY OF THE DISCLOSURE

According to the present disclosure, there is provided a spray dispenser. The spray dispenser has a spray mechanism and a bottle. The spray mechanism includes a sprayer and an elongated siphon tube. The siphon tube defines a proximal end and a distal end. The proximal end of the siphon tube is in fluid communication with the sprayer. The bottle defines an inverted catchment therein adjacent a wall of the bottle. The siphon tube defines a generally U-shaped portion therein proximal to the distal end of the siphon tube. The distal end of the siphon tube is positioned within the inverted catchment.

According to the present disclosure, there is provided a spray product. The spray product has a spray mechanism, a bottle, and a liquid formulation situated in the bottle. The spray mechanism and the bottle are as described above.

According to the present disclosure, there is provided a method for applying a liquid formulation to a surface. The method has the step of spraying a liquid formulation from the spray dispenser described above onto a surface.

DETAILED DESCRIPTION OF THE DISCLOSURE

Figure 1:
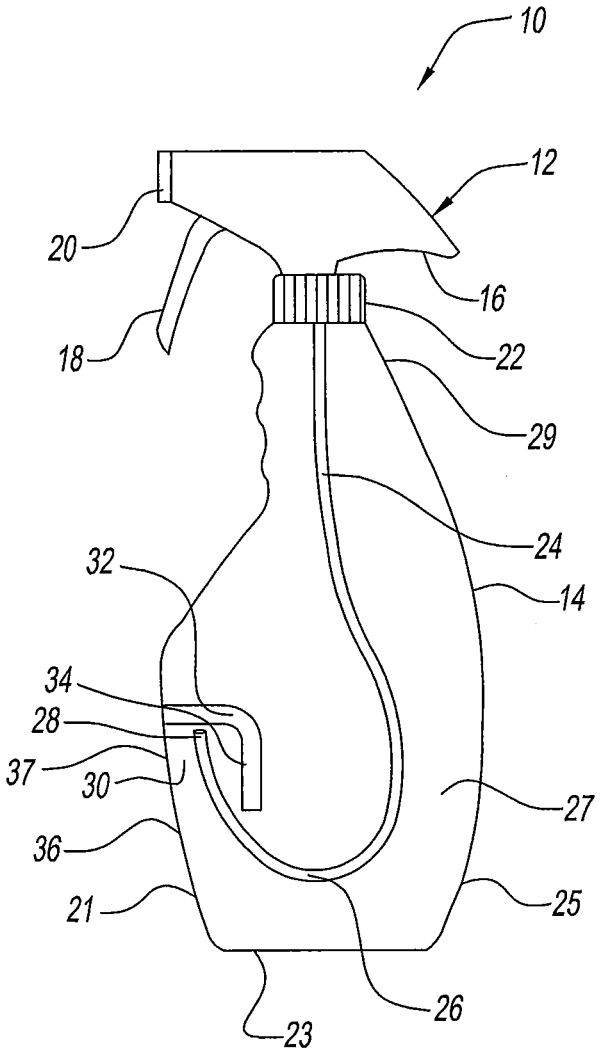
FIG. 1 depicts a side view of an embodiment of a spray dispenser according to the present disclosure.
Figure 2:
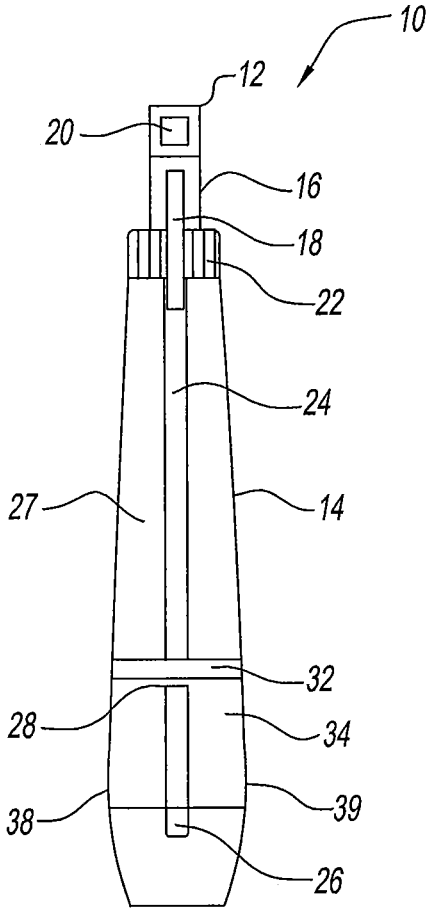
FIG. 2 depicts a front view of the spray dispenser of FIG. 1.

An embodiment of the spray dispenser of the present disclosure is shown in FIGS. 1 and 2 and is generally referenced by the numeral 10. Spray dispenser 10 has a spraying mechanism 12 and a bottle 14. The spraying mechanism 12 has a sprayer 16, a screw cap 22, and an elongated siphon tube 24. Sprayer 16 has a trigger 18 and a nozzle 20. Siphon tube 24 defines a generally U-shaped portion 26 and has a distal end 28. Bottle 14 has a front wall 21, a bottom wall 23, a rear wall 25, and a top portion 29. Bottle 14 defines a chamber 27 therein. Bottle 14 defines an inverted catchment 30 therein at a front portion 36 of bottle 14. Inverted catchment 30 has a horizontally disposed first member 32 and a vertically disposed second member 34, which intersect each other at a right angle. Inverted catchment 30 takes the form of a receptacle and is formed by the confluence of members 32 and 34 and adjacent wall portions 37, 38, and 39 of front wall 21 of bottle 14. Inverted catchment 30 is situated generally medially with respect to the vertical extension of bottle 14. Distal end 28 of siphon tube 24 is positioned substantially coextensive with the vertical extension of bottle 14 and within inverted catchment 30.

In embodiments of the type disclosed in FIGS. 1 and 2, the inverted catchment of the spray dispenser takes the form of a receptacle formed by the confluence of the first and second members and adjacent inner wall surfaces of the bottle and is open to liquid infiltration at the open bottom thereof. The first and second members are angled with respect to each other and preferably of unitary construction, i.e., formed from a single piece. The angle between the first and second member inside the inverted catchment can range broadly, but will typically range from about 30° to about 120° and will most typically be a right angle.

Figure 3:
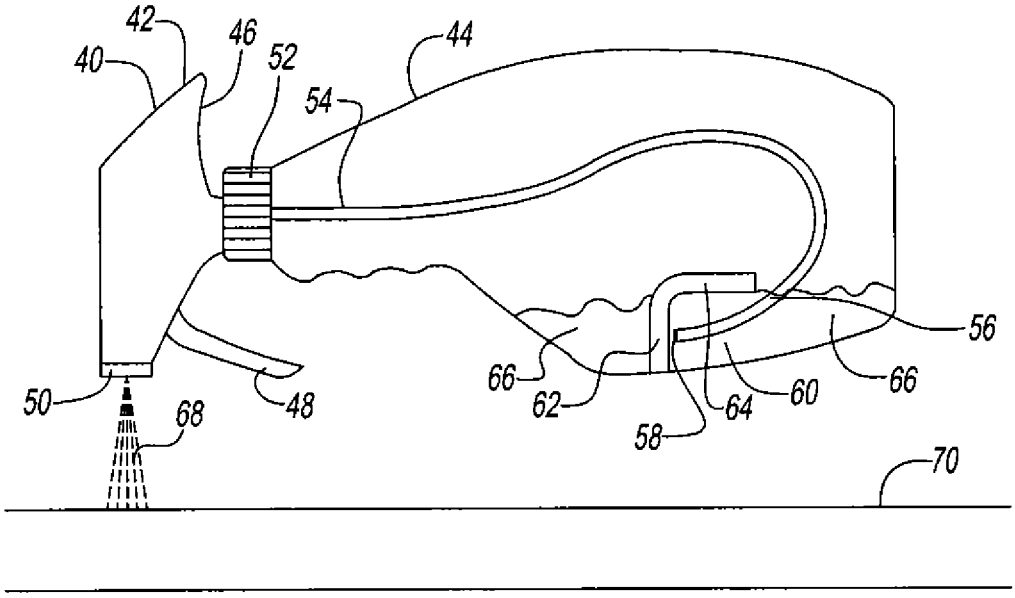
FIG. 3 depicts a side view of a liquid formulation being sprayed from a spray dispenser according to the present disclosure.

Another embodiment of the spray dispenser substantially similar to that shown in FIG. 3 is shown in deployed position and is generally referenced by the numeral 40. Spray dispenser 40 has a spraying mechanism 42 and a bottle 44. The spraying mechanism 42 has a sprayer 46, a screw cap 52, and an elongated siphon tube 54. Sprayer 46 has a trigger 48 and a nozzle 50. Siphon tube 54 defines a generally U-shaped portion 56 and has a distal end 58. Bottle 44 defines an inverted catchment 60 therein at a front portion 66 of bottle 64. Inverted catchment 60 has a horizontally disposed member 62 and a vertically disposed member 64, which intersect each other at a right angle. Inverted catchment 60 takes the form of a receptacle and is formed by the confluence of members 62 and 64 and adjacent wall portions of bottle 44. Inverted catchment 60 is situated generally medially with respect to the vertical extension of bottle 44. Distal end 58 of siphon tube 54 is positioned substantially coextensive with the vertical extension of bottle 44 and within inverted catchment 60. Spray dispenser 40 has a quantity of a liquid formulation 66 with bottle 44 and is shown in FIG. 3 emitting a spray 68 directed to horizontal surface 70. Spray 68 results from squeezing of trigger 48 by hand (not shown).

Figure 4:
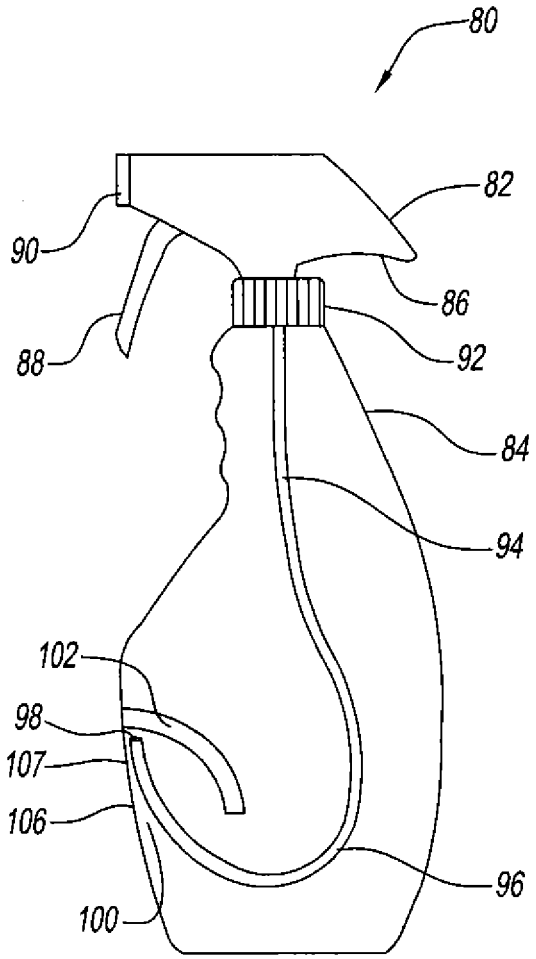
FIG. 4 depicts a side view of another embodiment of a spray dispenser according to the present disclosure.
Figure 5:
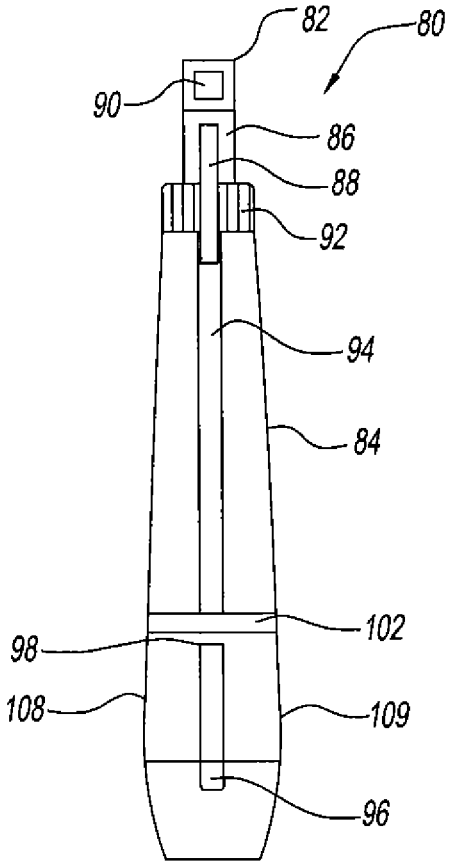
FIG. 5 depicts a front view of the spray dispenser of FIG. 4.

Another embodiment of the spray dispenser substantially similar to that shown in FIGS. 4 and 5 is generally referenced by the numeral 80. Spray dispenser 80 has a spraying mechanism 82 and a bottle 84. The spraying mechanism 82 has a sprayer 86, a screw cap 92, and an elongated siphon tube 94. Sprayer 85 has a trigger 88 and a nozzle 90. Siphon tube 94 defines a generally U-shaped portion 106 and has a distal end 98. Bottle 94 defines an inverted catchment 100 therein at a front portion 106 of bottle 84. Inverted catchment 100 has a curvilinear member 102. Inverted catchment 100 takes the form of a receptacle and is formed by the confluence of member 102 and adjacent wall portions 107, 108, and 109 of bottle 84. Inverted catchment 100 is situated generally medially with respect to the vertical extension of bottle 84. Distal end 98 of siphon tube 94 is positioned substantially coextensive with the vertical extension of bottle 84 and within inverted catchment 100.

Figure 6:
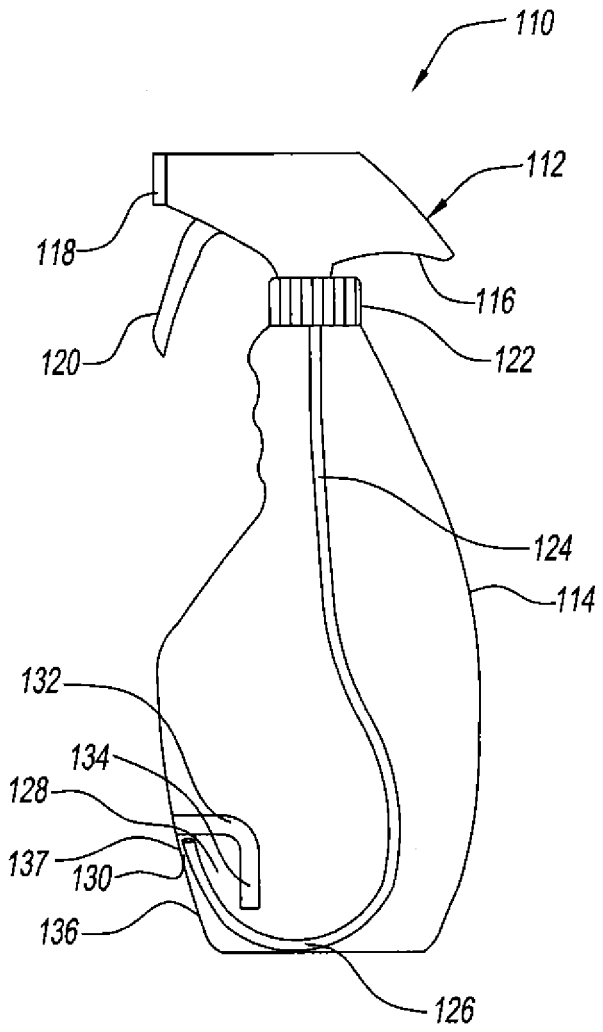
FIG. 6 depicts a side view of another embodiment of a spray dispenser according to the present disclosure.
Figure 7:
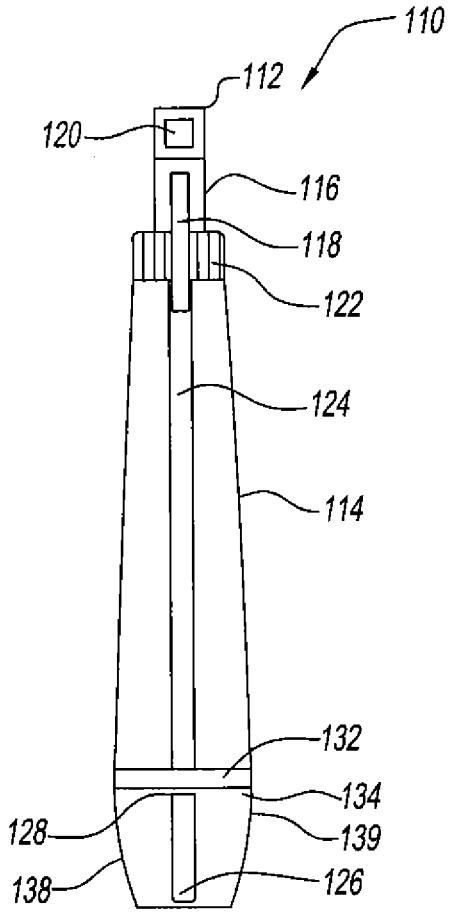
FIG. 7 depicts a front view of the spray dispenser of FIG. 6.

Another embodiment of the spray dispenser of the present disclosure is shown in FIGS. 6 and 7 and is generally referenced by the numeral 110. Spray dispenser 110 has a spraying mechanism 112 and a bottle 114. The spraying mechanism 112 has a sprayer 116, a screw cap 122, and an elongated siphon tube 124. Sprayer 115 has a trigger 118 and a nozzle 120. Siphon tube 124 defines a generally U-shaped portion 126 and has a distal end 128. Bottle 114 defines an inverted catchment 130 therein at a front portion 136 of bottle 114. Inverted catchment 130 has a horizontally disposed first member 132 and a vertically disposed second member 134, which intersect each other at a right angle. Inverted catchment 130 takes the form of a receptacle and is formed by the confluence of members 132 and 134 and adjacent wall portions 137, 138, and 139 of bottle 114. Inverted catchment 130 is situated generally medially with respect to the vertical extension of bottle 114. Distal end 128 of siphon tube 124 is positioned substantially coextensive with the vertical extension of bottle 114 and within inverted catchment 130.

Inverted catchments of the spray dispensers of the present disclosure are preferably structurally bounded such that liquid infiltration occurs only through an open bottom. When the spray dispenser is deployed substantially horizontally for purpose of applying a liquid formulation to a horizontal surface, the liquid formulation will flow into the inverted catchment for withdrawal through the siphon tube.

The inverted catchment may be situated anywhere along the inner wall in the bottle but is preferably situated proximal to the bottom of the bottle. The catchment is preferably situated within about 60% and more preferably about 10% to about 30% along the length of the vertical extension of the bottle taken from the reference point of the bottom of the bottle to the top of the cap. Further preferably, the portion of the members and/or walls that form the inverted catchment that is uppermost (with reference from the bottom of the bottle to the top of the cap) along the vertical extension of the bottle is also at up to 60% and more preferably about 10% to about 30% (e.g., first member 32 in FIGS. 1 and 2, the confluence of curvilinear member 102 and wall portion 107 in FIG. 4, and first member 132 in FIGS. 6 and 7).

The elongated siphon tube extends from the spraying mechanism, e.g., the trigger head, and is open at its distal end. When the trigger of the spraying mechanism is actuated, suction occurs within the siphon tube and liquid from within the bottle is drawn therefrom through the open distal end and forced out of the nozzle. The siphon tube defines a generally U-shaped portion proximal to its distal end. In some embodiments, the "bend" or location/section of curvature in the siphon tube will be in the last one-half or last one-third of the length thereof as in the embodiments depicted herein. The distal end is positioned or situated within the inverted catchment so as to access the liquid formulation when the catchment is filled during horizontal deployment of the spray dispenser. The farther the distal end extends into the inverted catchment and the closer it extends to the inner wall of the bottle, the greater the proportion of liquid formulation that can be sprayed from within the bottle. In some embodiments, such as the embodiments depicted herein, the portion of the siphon tube within the inverted catchment will be substantially vertical, i.e., within about 45° of vertical and more typically about 30° of vertical. In a preferred embodiment, the elongated siphon tube will be of length sufficient for the distal end of the siphon tube to abut or substantially abut the inner wall of the bottle within the inverted catchment so that the distal end will be static or immobilized within the inverted catchment (for example, the embodiment in FIGS. 6 and 7).

The components of the spray dispenser, including the bottle, inverted catchment, and siphon tube, can be formed from any conventional material but will typically be formed from a thermoplastic. Useful thermoplastics include, for example, polyethylene, polypropylene, polyester, and vinyl chloride. When a thermoplastic is employed, the components can be formed by any method known in the art, such as blow molding, injection molding, extrusion, and stamping. The thermoplastic can be transparent, translucent, or opaque as desired. The embodiments depicted herein employ a transparent thermoplastic so that the internal components of the bottle of the spray dispenser will be apparent in the several views. Most typically, commercial embodiments will employ an opaque thermoplastic.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances that fall within the scope of the appended claims.

What is claimed is:

1. A spray dispenser, comprising:

a spray mechanism and a bottle, wherein the spray mechanism includes a sprayer, a siphon tube, and a screw cap, wherein the screw cap is affixed to the bottle at a top portion of the bottle, wherein the siphon tube defines a proximal end and a distal end, wherein the proximal end of the siphon tube is in fluid communication with the sprayer, wherein the bottle defines an inverted catchment therein adjacent a front wall in a front portion of the bottle, wherein the inverted catchment is situated entirely in the front portion of the bottle, wherein the siphon tube defines a generally U-shaped portion therein proximal to the distal end of the siphon tube, wherein the distal end of the siphon tube is open and positioned within the inverted catchment wherein the inverted catchment opens toward a bottom wall, wherein the U-shaped portion opens toward the top portion of the bottle, wherein the siphon tube abuts the bottom wall at a location outside of the inverted catchment and extends away from the bottom wall into the inverted catchment, wherein the siphon tube is free of abutment with a rear wall, wherein the rear wall faces the front wall, and wherein the spray mechanism is a trigger sprayer.

2. The dispenser of claim 1, wherein the inverted catchment includes substantially linear first and second members extending from the front wall, wherein the first and second members are positioned at an angle with respect to each other.

3. The dispenser of claim 1, wherein the inverted catchment includes substantially linear first and second members extending from the front wall, wherein the first and second members are positioned at substantially a right angle with respect to each other.

4. The dispenser of claim 1, wherein the inverted catchment includes a member extending from the front wall, wherein the member is curvilinear substantially along its entire length.

5. A spray product, comprising:

a spray mechanism;

a bottle; and a liquid formulation situated in the bottle, wherein the spray mechanism includes a sprayer, a siphon tube, and a screw cap, wherein the screw cap is affixed to the bottle at a top portion of the bottle, wherein the siphon tube defines a proximal end and a distal end, wherein the proximal end of the siphon tube is in fluid communication with the sprayer, wherein the bottle defines an inverted catchment therein adjacent to a front wall in a front portion of the bottle, wherein the inverted catchment is situated entirely in the front portion of the bottle, wherein the siphon tube defines a generally U-shaped portion therein proximal to the distal end of the siphon tube, wherein the distal end of the siphon tube is open and positioned within the inverted catchment wherein the inverted catchment opens toward from a bottom wall, wherein the U-shaped portion opens toward the top portion, wherein the siphon tube abuts the bottom wall at a location outside of the inverted catchment and extends away from the bottom wall into the inverted catchment, wherein the siphon tube is free of abutment with a rear wall, wherein the rear wall faces the front wall, and wherein the spray mechanism is a trigger sprayer.

6. A method for applying a liquid formulation to a surface, comprising: spraying the liquid formulation of the spray product of claim 5 to the surface.

* * * * *